US005709050A

United States Patent [19]

Benko

[11] Patent Number: 5,709,050

[45] Date of Patent: Jan. 20, 1998

[54] MEZZANINE SAFETY GATE

[75] Inventor: John C. Benko, Westlake, Ohio

[73] Assignee: Benko Engineering, Inc., Sheffield Village, Ohio

[21] Appl. No.: 756,059

[22] Filed: Nov. 26, 1996

[51] Int. Cl.[6] ..... E05C 7/06

[52] U.S. Cl. ..... 49/109; 49/104; 49/203

[58] Field of Search ..... 49/68, 73, 93, 49/95, 96, 97, 104, 105, 108, 109, 110, 112, 114, 116, 118, 119, 122, 139, 197, 199, 203, 204, 205; 109/13

[56] References Cited

U.S. PATENT DOCUMENTS 4,014,133 3/1977 Brown ..... 49/197 X
4,041,646 8/1977 Mittag .
4,150,510 4/1979 Harrison et al. .
4,422,264 12/1983 Harris .
4,538,379 9/1985 Vargo .
4,580,413 4/1986 Klee ..... 49/116 X
5,546,703 8/1996 Conway .

*Primary Examiner*—Jerry Redman
*Attorney, Agent, or Firm*—Renner, Otto, Boisselle, Sklar

[57] ABSTRACT

A staging area for an elevated mezzanine or platform includes side railings and elevated center stanchions providing a pivot for a gate assembly alternately closing the ends of the side railings enclosing at all time at least three sides of the staging area. The two gates of the assembly extend at right angles to each other and when one is vertical and down, the other is horizontal and up. The main side frames of the gate assembly are M-shape with splayed legs, and the assembly is pivoted to the tops of the stanchions at the vertex of the center V of the M.

17 Claims, 3 Drawing Sheets

MEZZANINE SAFETY GATE

DISCLOSURE

This invention relates generally as indicated to a mezzanine or platform safety gate, and more particularly to a simplified gating system for elevated edges.

BACKGROUND OF THE INVENTION

Elevated storage and work platforms such as mezzanines require safety railings for fall protection. Placing material to be stored on the mezzanine is usually accomplished by a fork lift truck which elevates a pallet, for example, and places it on the edge of the mezzanine at a staging area to be moved from the area to storage. A railing gate is required for this purpose, but it can not be left open.

A solution to the problem is the establishment of a mezzanine loading and unloading or staging area which is itself enclosed by railings and which has alternate gates, one opening and closing the edge of the mezzanine or platform, while the other closes and opens access to the staging area from the mezzanine.

Various attempts have been made to provide gating systems, and examples are seen in prior U.S. Pat Nos. 4,041,646, 4,150,510, 4,422,264, 4,538,379 and 5,546,703. Counter-weighted single gate systems are seen in U.S. Pat. No. 4,150,510. In one position both ends of the loading or staging area are open. Alternately to close both ends of the staging area requires a 180° pivot. Moreover, the counterweights are difficult to adjust and still clear the mezzanine floor. In U.S. Pat. No. 4,041,646 no loading or staging area is provided. The two door or gate overhead system of U.S. Pat. No. 4,422,268 has itself no side enclosures and does not come close enough to the floor. The gate of U.S. Pat. No. 5,546,703 does not close the inner end of the staging area leaving a significant lateral opening.

There is, therefore, a need for a simplified loading or staging area safety enclosure for mezzanines and the like which is easy to install and operate and which will fully and safely enclose alternate ends of the staging area in alternate positions.

SUMMARY OF THE INVENTION

A mezzanine or elevated platform staging area safety gate includes two side railings extending normal to the edge of the mezzanine or platform and forming a continuation of the safety railing at the edge. The side rails are alternately open at each end, one end being at the edge and the other end being spaced from the edge. Such side railings and ends form a loading and unloading or staging area at the edge of the platform or mezzanine. Center stanchions project above the side railings and provide axially aligned pivots for a swinging gate assembly which alternately opens and closes the ends of the staging area. The gate assembly includes two interconnected side frames each of which includes two main struts extending normal to each other and forming a right angle V, with the vertex of the V being pivoted at the top of the stanchions. The gate assembly is generally M-shape in side elevation with splayed legs.

Extending normal to each main strut at its outer end is a gate strut. The respective or opposed gate struts are interconnected by railings to form gates for the ends of the staging area. Bumpers on the interior of the gates engage the ends of the side railings when the gates are closed. In this manner the two gates at the opposite ends of the gate assembly are at right angles to each other and when one is down and vertical closing one end of the staging area, the other is up and horizontal providing significant vertical clearance to the area. One or the other end of the staging area is closed in the alternate swinging positions of the gate assembly. The gates include railings which may be padded for protection and the bottom railing is sufficiently elevated to clear the tines of a fork lift and pallet pockets on which a load may be situated. The gate assembly is balanced so that little force is required to swing the gate assembly to its alternate positions. In one form the gate assembly may be power driven and controlled manually or remotely.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
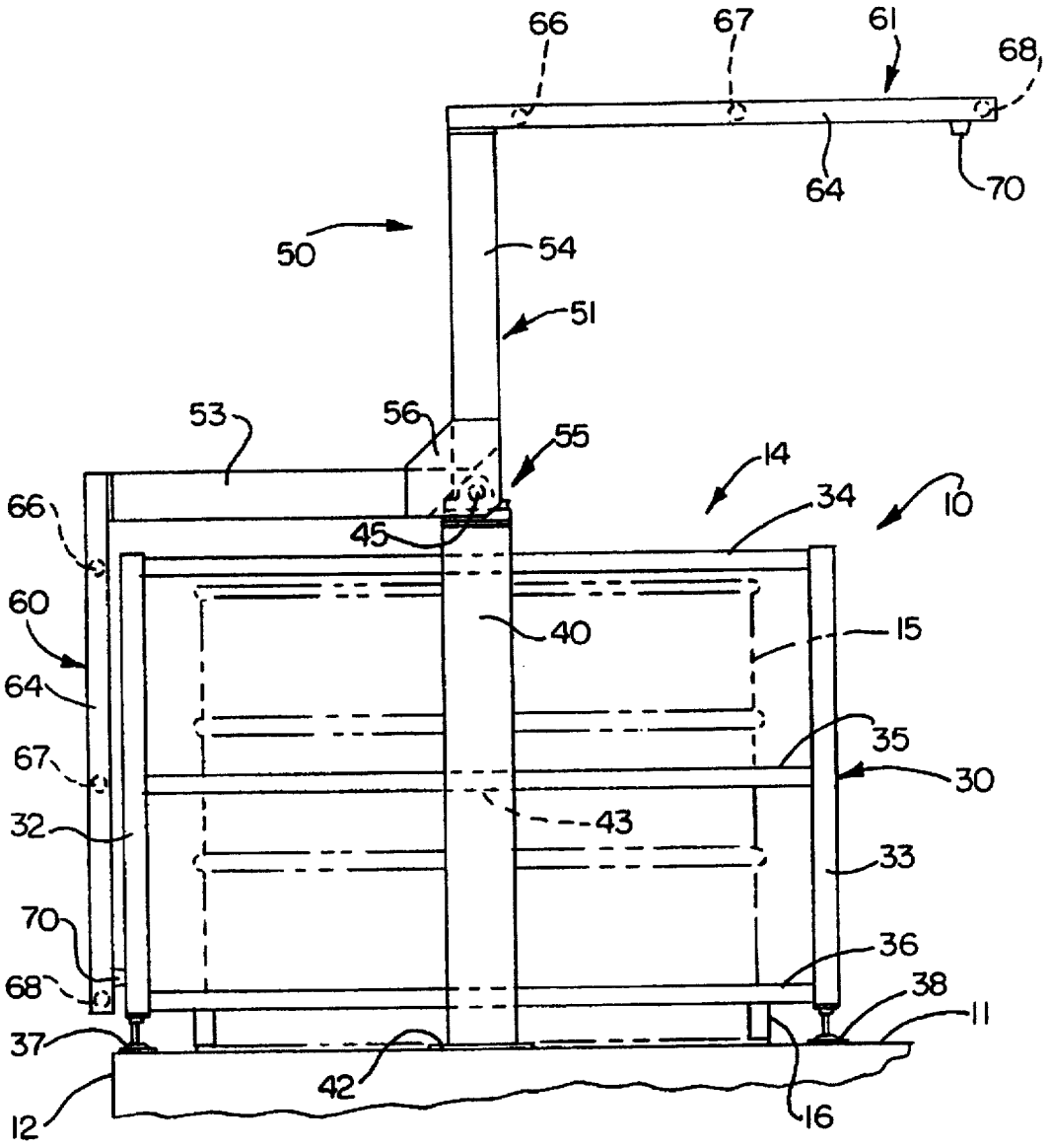
FIG. 1 is a side elevation of the mezzanine or platform safety gate of the present invention.
Figure 2:
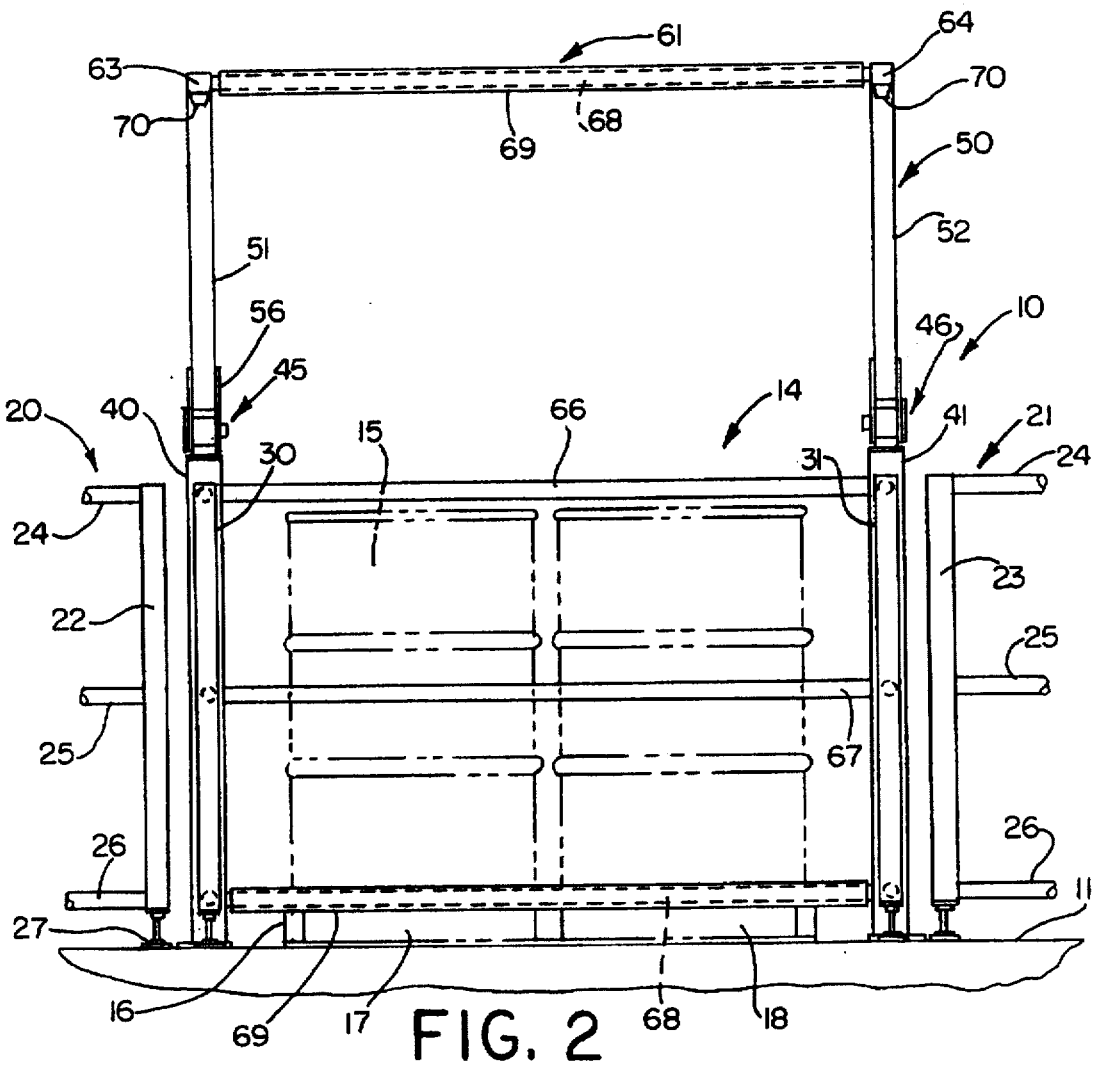
FIG. 2 is a rear elevation as seen from the right hand side of FIG. 1.

Referring initially to FIGS. 1 and 2, there is illustrated a safety gate system for elevated platforms or mezzanines in accordance with the invention shown generally at 10. The safety gate system is provided on a mezzanine or elevated platform surface shown generally at 11 which includes an edge 12. The purpose of the system is to provide an enclosed loading or unloading zone or staging area shown generally at 14. The area 14 is adjacent the edge 12 and permits loads such as the drums illustrated in phantom lines at 15 supported on pallet 16 to be positioned and removed from the staging area either from below the edge 12 or from the surface of the elevated platform or mezzanine, without compromising the safety railing at the edge of the mezzanine. The load may vary widely, but they are normally moved by the tines of a fork lift truck which enters the pockets of the pallet as seen at 17 and 18 in FIG. 2. Whether the pallet be a plastic, wood, or a metal skid, the pockets normally extend completely through the pallet so that the pallet can be elevated by the fork lift truck from either end.

Referring now primarily to FIG. 2 there is illustrated at 20 and 21 the railing for the edge of the mezzanine or platform. Each railing includes posts seen at 22 and 23, respectively, each with three horizontal railings shown at 24, 25, and 26, extending horizontally along the edge to the next post. The posts are secured to the surface 11 as indicated at 27. As illustrated, between the posts 22 and 23 there is a slight gap which forms the lateral dimension of the staging area 14.

Extending rearwardly from the edges of such gap and the edge of the mezzanine or platform are two side railings seen generally at 30 and 31. Such railings extend from the edge toward the viewer in FIG. 2 and perpendicular to the edge 12 as seen in FIG. 1. Also as seen in FIG. 1 each side railing includes end posts 32 and 33 which are interconnected by a top railing 34, an intermediate railing 35, and a bottom railing 36. The end posts are secured to the surface 11 as indicated at 37 and 38, respectively. The two side railings confine the staging area 14 at its lateral sides.

Positioned in the center of each side railing is a stanchion as seen at 40 and 41, each of which is firmly secured to the surface floor 11 as seen at 42. The stanchions are somewhat larger and stronger than the posts of the side railings and the horizontal rails may extend through the stanchions as indicated at 43 in FIG. 1. The stanchions project a significant distance above the top railing 34 and support axially aligned pivots shown generally at 45 and 46.

The pivots hingedly support a two-gate gate assembly illustrated at 50. The gate assembly comprises two main side frames shown generally at 51 and 52 which have the shape in elevation (FIG. 1) of a right angle V. Each frame includes legs 53 and 54 formed of rectangular tubes, and which are joined at the vertex 55 by gusset plates 56. Gates 60 and 61 extend normal to the outer ends of the legs 53 and 54 spanning the side frames.

Figure 3:
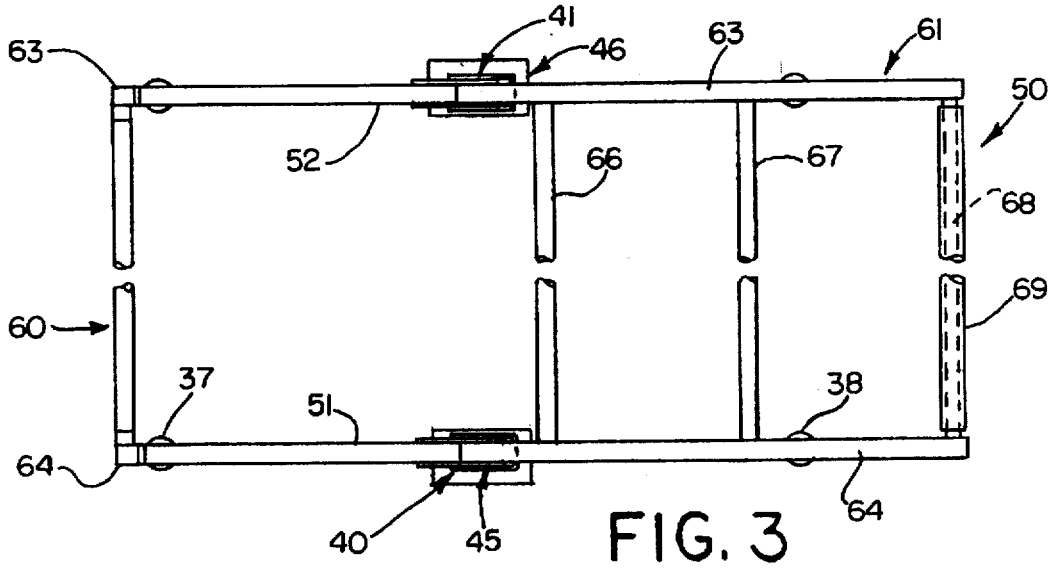
FIG. 3 is a fragmentary top plan view of the gate laterally foreshortened.

As seen more clearly in FIG. 3, each gate includes outwardly extending side posts 63 and 64. Spanning the side posts are horizontal railings 66, 67 and 68. The latter is the outer or lowermost railing is provided with protective padding such as sponge rubber or urethane indicated at 69. This padding is shown more clearly in FIG. 5. The interior of each side post near the outer end is provided with a rubber bumper indicated at 70. Such bumpers are designed to engage the exterior of the lower portion of the end posts of the side railings at seen at the left hand side of FIG. 1 when the gate is in its down or closed position.

The two gates of the gate assembly are identical only they extend at right angles to each other from the ends of the main elements of the V-shape side frames. When the gate 61 is up and horizontal as seen in FIG. 1 the gate 60 is down and vertical. When the gate assembly swings through a 90° arc to its opposite position, the gate 60 will be up and horizontal while the gate 61 is down and vertical. The gates thus close the ends of the side rails alternately. In the position shown in FIG. 1, the left hand side of the staging area at the edge is closed. By pivoting the gate assembly 90°, that end of the staging area will be open while the end interior of the edge will be closed.

As seen more clearly in FIG. 2, the lowermost railing for the gate in the closed position will be positioned slightly above the pockets 17 and 18 of the pallet 16. In this manner the operator of the fork lift truck may position the tines of the fork lift truck into the pockets before the gate is actually opened.

It is also noted that when the gate 61 is open as seen in FIG. 1, the gate is at a substantial elevation provided by the vertically aligned stanchion 40 and the leg 54 of the V-shape side frame. This provides substantial vertical clearance for access to the staging area if required while the gate 60 is down and closed. With the gate assembly illustrated, the pivot is sufficiently high to provide clearance between the side frames and the top of the side railings, and provide excellent vertical clearance for large or high loads being positioned into or removed from the staging area.

Figure 4:
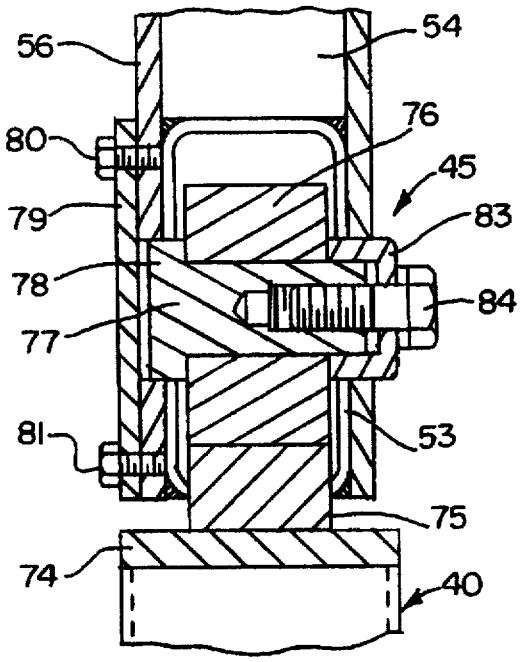
FIG. 4 is an enlarged fragmentary section through the gate pivot on the top of the stanchion.

Referring now to FIG. 4 it will be seen that the top of the stanchion 40 may be provided with a top plate or cap 74 which receives a bearing spacer 75 on which bearing 76 is secured by suitable fasteners. The bearing 76 may be in the form of a sleeveless pillow block made of bearing material such as certain alloys or plastics with self lubricity characteristics. The bearing provides a bore for receiving a pivot pin 77. One end of the pivot pin includes a head 78 interfitting with keeper plates 79 secured by the fasteners 80 and 81 to the exterior of the gusset 56 at the vertex 55. This locks the rigid V-shape frame and the pivot pin for unitary rotation within the bearing at the vertex of each side frame. The pivot pin is secured in place on the opposite side of the head 78 by a clamp sleeve 83 and fastener 84.

Figure 5:
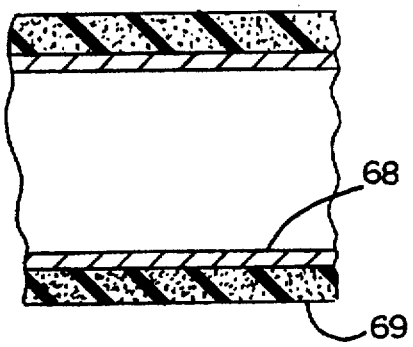
FIG. 5 is an enlarged fragmentary section of the protective padding which may used on the cross railings of the gate.

It is noted that the two-gate gate assembly as seen in edge elevation in FIG. 1 generally resembles the shape of the letter M, the center V providing the rigid side frames and being pivoted to the stanchions at the vertex of each V. The gates form the legs of the letter M but are splayed at right angles to each other. Because the two-gate gate assembly is always to some extent counterbalanced, it can readily manually be swung through its 90° arc to close alternate ends of the staging area. The gate assembly is relatively light weight since the main struts, posts and railings are made from tubular material as seen in FIGS. 4 and 5.

Figure 6:
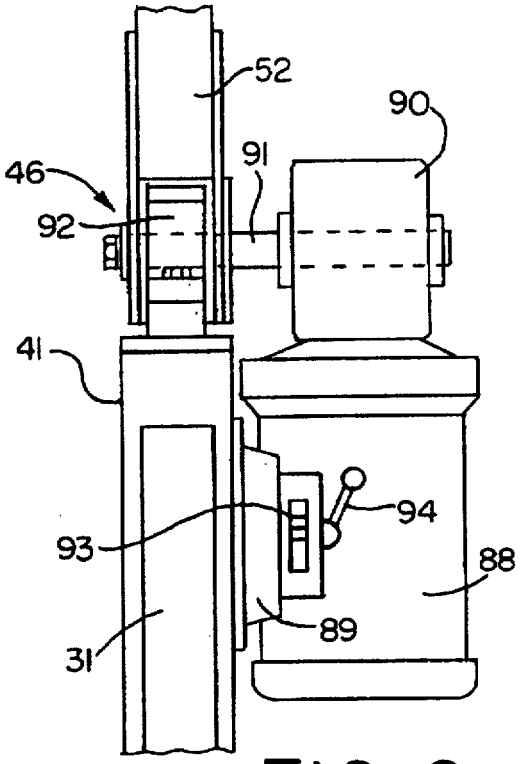
FIG. 6 is a somewhat enlarged fragmentary elevation of the top of a stanchion illustrating a motorized embodiment of the safety gate.

It will be appreciated that the gate assembly may also be power driven as illustrated in the embodiment of FIG. 6. A motor 88 is mounted on the exterior of stanchion 41 by bracket 89 and includes a transmission or reducer 90 driving shaft 91 extended through the bearing 92 and rigidly connected to the side frame 52. The motor 88 may be controlled manually by a switch as indicated at 93, or remotely through antenna 94 in much the same fashion as a garage door opener. In this manner, for example, the forklift truck operator may control the operation of the gate from the vehicle. It can now be seen that there is provided a staging area for an elevated mezzanine or platform which includes side railings and elevated center stanchions providing a pivot for a gate assembly alternately closing the ends of the side railings, enclosing at all times on at least three sides the staging area. It will also be appreciated that if the safety gate assembly of the present invention is installed along with the edge railing seen in FIG. 2, the edge railings and side railings will may share a common post adjacent the staging area at the edge. Also, if the staging area is adjacent a wall, one of the side railings may be omitted.

The two gates of the assembly extend at right angles to one another, and when one is vertical and down, the other is horizontal and up. The main side frames of the gate assembly in elevation are M-shape with splayed legs, and the gate assembly is pivoted at the vertex of the center V.

To the accomplishment of the foregoing and related ends, the invention then comprises the features particularly pointed out in the claims, these being indicative, however, of but a few of the various ways in which the principles of the invention may be employed.

I claim:

1. A platform safety gate positioned along an edge of an elevated platform at a staging area, spaced apart side railings extending normal to said edge, a spacing of the side railings generally corresponding to that of the staging area, an M-shaped gate assembly spanning the side railings and having two gates extending substantially at right angles to each other interconnected by a right angle center V-frame having legs meeting at a vertex, the vertex of the V-frame being pivoted about a pivot centered and above the side rails so that said gates close alternate ends of said side rails as said gate assembly is pivoted.

2. A safety gate as set forth in claim 1 wherein the legs of the center V-frame are such that when the gate supported by one leg of the V-frame is open, that leg extends vertically from the pivot and the respective connected gate is horizontal and elevated.

3. A safety gate as set forth in claim 2 wherein the legs of the center V-frame are such that when the gate supported by one leg of the V-frame is closed, that leg extends horizontally from the pivot, and the respective connected gate is down and vertical.

4. A safety gate as set forth in claim 3 wherein each gate is supported to extend from the legs of the V-frame to form splayed legs of the M.

5. A safety gate as set forth in claim 4 wherein each gate includes horizontal railings one of which is lowermost when the gate is closed, at least the lowermost of which is padded.

6. A safety gate as set forth in claim 5 wherein the lowermost railing is sufficiently elevated to clear a fork lift tine.

7. A safety gate as set forth in claim 6 including a drive motor to move said gate assembly to close alternate ends of the side rails.

8. A staging area comprising a safety railing along edges of said staging area and having a gap defining a width of said staging area, side rails extending from the edges along the staging area, stanchions centrally located with respect to each side rail and forming an elevated central pivot, and a two-gate assembly pivoted to said stanchions through an arc of 90°, said gates extending at 90° to each other and being arranged to abut against and close opposite ends of said side rails alternately when pivoted 90°.

9. An area as set forth in claim 8 wherein said gate assembly comprises main right angle side struts each having an end and a vertex pivoted to said stanchions.

10. An area as set forth in claim 9 including gates extending at right angles from the end of each strut away from the vertex.

11. An area as set forth in claim 10 wherein said gate assembly has an appearance in elevation of an M with right angle splayed legs.

12. An area as set forth in claim 8 wherein said stanchions project above said side rails to provide a clearance between said gate assembly and said side rails.

13. An area as set forth in claim 12 wherein said side rails include horizontal railings projecting through said stanchions.

14. An area as set forth in claim 8 including horizontal railings for each gate of said two gate assembly one of which is lowermost, at least the lowermost of each railing including pad protection.

15. An area as set forth in claim 8 wherein each gate of said two gate assembly includes a bottom railing, said bottom railing being positioned to provide clearance for a fork lift tine.

16. An area as set forth in claim 8 including power means to swing said gate through said arc of 90° alternately to close opposite ends of said side rails.

17. An area as set forth in claim 16 including control means for said power means operable manually or remotely.

* * * * *